US009636600B2

(12) United States Patent
Rudisill et al.

(10) Patent No.: US 9,636,600 B2
(45) Date of Patent: May 2, 2017

(54) TILE CONSTRUCTION SET USING PLASTIC MAGNETS

(71) Applicants: Charles A. Rudisill, Apex, NC (US); Daniel John Whittle, Bellingham, WA (US)

(72) Inventors: Charles A. Rudisill, Apex, NC (US); Daniel John Whittle, Bellingham, WA (US)

(73) Assignee: APEX TECHNOLOGIES, INC., Apex, NC (US)

( * ) Notice: Subject to any disclaimer, the term of this patent is extended or adjusted under 35 U.S.C. 154(b) by 1085 days.

(21) Appl. No.: 13/766,776

(22) Filed: Feb. 14, 2013

(65) Prior Publication Data

US 2014/0227934 A1 Aug. 14, 2014

(51) Int. Cl.
*A63H 33/04* (2006.01)
*A63H 33/06* (2006.01)

(52) U.S. Cl.
CPC ..... *A63H 33/046* (2013.01)

(58) Field of Classification Search
CPC ..... A63H 33/046; A63H 33/26; H01F 7/02–7/0231; H01F 7/0252–7/0268
See application file for complete search history.

(56) References Cited

U.S. PATENT DOCUMENTS 2,872,754 A 2/1959 Cronberger
3,254,440 A 6/1966 Duggar
3,998,004 A 12/1976 Ehrlich
5,021,021 A 6/1991 Ballard
5,411,262 A 5/1995 Smith
5,942,961 A * 8/1999 Srail ..... H01F 7/0215 335/284
5,994,990 A * 11/1999 Ogikubo ..... G09B 9/14 335/285
6,017,220 A 1/2000 Snelson
6,024,626 A 2/2000 Mendelsohn
6,431,936 B1 8/2002 Kiribuchi
6,969,294 B2 11/2005 Vicentelli
(Continued)

FOREIGN PATENT DOCUMENTS

DE 3929190 A1 1/1990
DE 9304198 U1 10/1993
(Continued)

OTHER PUBLICATIONS

Magna-Tiles FAQ downloaded from www.magnatiles.com/FAQ.
(Continued)

*Primary Examiner* — Aarti B Berdichevsky
*Assistant Examiner* — Urszula M Cegielnik
(74) *Attorney, Agent, or Firm* — Patent Leverage LLC; Daniel J. Whittle

(57) ABSTRACT

A magnetic tile construction set is disclosed that may be used to construct extended 3-dimensional structures. In one embodiment, plastic magnets are attached to multiple edges of a lightweight core. The magnets have a width and length comparable to the thickness of the core and a length that is an order of magnitude longer than the thickness of the core. Tiles may be attached to one another at the tile edges through magnetic forces that do not vary by more than a factor of two over the range of angles from 45 degrees to 180 degrees.

16 Claims, 13 Drawing Sheets

(56) References Cited

U.S. PATENT DOCUMENTS

| | | | | |
|---|---|---|---|---|
| 7,154,363 | B2 | 12/2006 | Hunts | |
| 7,160,170 | B2 | 1/2007 | Yoon | |
| 7,988,518 | B2 | 8/2011 | Kim et al. | |
| 8,187,006 | B2 * | 5/2012 | Rudisill ..... | H01R 11/30 362/249.06 |
| 2010/0056013 | A1 | 3/2010 | Kaplan | |

FOREIGN PATENT DOCUMENTS

| | | | |
|---|---|---|---|
| EP | 2055363 | A1 | 5/2009 |
| GB | 726328 | A | 3/1955 |
| GB | 2385805 | A | 9/2003 |
| JP | 2001173889 | A | 6/2001 |
| JP | 2003190663 | A | 7/2003 |
| JP | 3822062 | B2 | 9/2006 |
| KR | 20100107606 | A | 10/2010 |
| WO | WO8400232 | A1 | 1/1984 |
| WO | WO2006132458 | A1 | 12/2006 |
| WO | WO2008142487 | A1 | 11/2008 |

OTHER PUBLICATIONS

Magformers Ideabook downloaded from http://www.magformers.com/assets/mag__ib.pdf, copyright 2012.

Product description and reviews of Magic Shapes 54 Piece Set downloaded from Amazon.com on Oct. 13, 2016 (webpage found at https://www.amazon.com/gp/product/B000WN6Y8M/ref=pd__sim__21__2?ie=UTF8&psc=1&refRID=AWMCRWRRJKD8V09CP0EY).

Product description and reviews of Magic Shapes Toy, Set of 81 downloaded from Amazon.com on Oct. 13, 2016 (webpage found at https://www.amazon.com/Edushape-Magic-Shapes-Toy-toys/dp/B001JEOGR4/ref=cm__cr__arp__d__product__top?ie=UTF8).

* cited by examiner

TILE CONSTRUCTION SET USING PLASTIC MAGNETS

FIELD OF THE INVENTION

The present invention relates generally to construction toys and, more particularly to planar modules with magnetic elements forming three-dimensional structures.

BACKGROUND OF THE INVENTION

Construction toys in which three dimensional structures can be assembled from a quantity of individual blocks have been popular for many years. Some of these construction sets contain individual parts that are shaped like miniature bricks or blocks. These essentially three-dimensional construction elements are characterized by having a length, width and thickness that are all comparable. One-dimensional construction elements have a length that is significantly longer than the width and thickness. Building tiles are essentially two-dimensional structures having a thickness that is significantly smaller than the length or width. Some of these planar structures can be connected along edges to form three-dimensional assemblies. Mechanical interlocking structures have been employed to connect individual construction toy elements together, but there are generally restrictions on assembly geometries or critical alignment requirements, excessive connection forces and angles, or cost issues driven by dimensional fabrication precision requirements. Accordingly, a need exists for a robust construction toy system that is easy to assemble and take apart by children that is inexpensive enough to provide a sufficient number of parts to build a variety of three-dimensional structures.

In the prior art, magnets have been used to provide an easier assembly experience compared to some mechanical structures. The orientational character of magnetic poles may restrict how pieces may be combined. This attraction/repulsion characteristic may be useful for puzzles, but may not be desirable for providing flexibility in combining magnetic building elements into extended three-dimensional structures. Various techniques for overcoming magnetic polarity issues have been proposed including providing a plurality of magnetic poles in a plastic magnet, increasing the number of magnets, adding ferromagnetic structures lacking permanent magnetic poles or providing cavities to accommodate rotating magnets. These are not completely satisfactory for building extended structures from sub-assembled structures easily or for other cost or application reasons. Pole orientations that were once free to rotate when only two elements are brought together to form a subassembly, frequently do not rotate thereafter. This may prevent the attachment to other subassemblies in a predictable manner or at the desired position or orientation.

The use of rare earth or other strong magnets in toys has lead to safety concerns particularly with ingestion of multiple rare-earth magnets by young children. Even weaker and less expensive ceramic ferrite magnets in toys may still have safety issues with magnetic strength and exposed sharp edges due to their brittle nature.

Rubber bonded ferrite or plastic composite magnets are not brittle and have a relatively weak magnetic flux density. In children's toys, plastic magnet tape is typically used to hold small items to steel surfaces such as refrigerator doors in planar arrays. Multiple magnetic poles on one plastic magnetic tape surface may be formed to provide adequate holding strength in the direction across the thickness of the tape. The reaching strength of the magnetic attractive force away from this surface generally diminishes rapidly and is even lower in other directions. When plastic magnets are used in construction toys, they are generally designed to connect to a metal surface or each other only in direct and extended planar contact. Magnetic forces are typically insufficient to make attachments at a relative angle between the edges of building tiles using surface polarized plastic magnet tape.

A need exists for a construction toy system that overcomes one or more of these shortcomings.

SUMMARY OF THE INVENTION

The present invention is designed to address at least one of the aforementioned problems and/or meet at least one of the aforementioned needs. Apparatuses, systems and methods are disclosed herein, which relate to planar construction toys with magnetic elements. In one embodiment, an apparatus is comprised of a planar tile with an essentially one-dimensional plastic magnet along a portion of one or more edges.

The present invention is designed to address at least one of the aforementioned problems and/or meet at least one of the aforementioned needs.

In one embodiment, an apparatus is comprised of a substantially planar core with plastic magnets affixed along two or more edges of the tile and which has a surface density of less than 0.2 grams/centimeter squared.

In one embodiment, the plastic magnets are substantially one-dimensional and have a cross-sectional ratio of width to thickness of less than 3.

In one embodiment, the plastic magnets of the apparatus are attached with their length along the direction of one or more external edges of a planar core. The magnet attachment means may comprise a flexible film and adhesive. The attachment means may comprise mechanical interlocking features.

In embodiments of this disclosure, the planar substrate may be folded or curved. In further embodiments of this disclosure, the magnet and/or the core may be flexible.

In embodiments of this disclosure, the apparatus may be a magnetic construction tile employing plastic magnets. A number of these tiles may be combined into a system comprising a toy construction set characterized by magnetic attraction force which does not vary by a factor of two over the range of angles of 45 degrees to 180 degrees along a common edge interface.

In embodiments of this disclosure, a kit may comprise magnets affixed to flexible or rigid films capable of attachment to planar substrates such that three-dimensional structures may be constructed through magnetic attraction.

In embodiments of this disclosure, the magnetic tile systems provide higher magnetic attraction forces when more than two tiles are attached along a common edge interface. In embodiments, the polarities of the magnets are fixed in position relative to the tiles to provide predictable attraction characteristics.

As used herein for the purposes of this disclosure, the term "plastic magnet" or "bonded magnet" should be understood to mean a magnet that is a composite of permanent magnetic particles and a polymeric binder. The permanent magnetic particles may consist of any type of permanent magnetic material, such as ceramic ferrite materials, rare earth magnetic materials or ferromagnetic alloys such as alnico. The polymeric binder may be any plastic or elastomer, including polyester, vinyl, silicone rubber, gum rubber, etc. For the purposes of this disclosure, the binder in a plastic magnet may also include epoxies or other reaction products as binders. The magnetic properties such as maximum magnetic flux density and maximum energy density are typically weaker with plastic magnets than with magnets made of the same magnetic material without the polymeric binder. As a class, plastic magnets typically have the lowest magnetic attractive force by volume of all magnet types. Plastic magnets may be mechanically rigid or flexible. For the purposes of this disclosure, the term "flexible" should be understood to mean capable of being bent into a curved shape of radius at least as small as 30 times the thickness of the element in a direction of the radius of curvature.

As is well known in the art, magnetic forces may exist between pairs of magnets and between a magnet and a material attracted to a magnet. The properties of magnetic poles are well known. Material attracted to a magnet that may not be a permanent magnet comprise the ferromagnetic materials and alloys comprising iron, nickel, cobalt, and gadolinium. Plastic magnets may be attracted to ferromagnetic materials. Particles of ferromagnetic materials may be compounded with polymers and formed into "plastic ferromagnets" that may be mechanically flexible or rigid. Ferromagnetic materials or plastic ferromagnets may be substituted for one of two magnets attracted to one another in the embodiments of this disclosure.

As used herein for the purposes of this disclosure, the term "planar building element", "planar construction element" or "building tile" should be interpreted as an element that has an average thickness dimension that is substantially less than its extent in the other two dimensions, that is, its length and width dimensions. The tile will still be considered planar even if its thickness is not constant if it meets this condition. It should be considered to be essentially two-dimensional when combined with other similar planar building tiles in a set to form extended three-dimensional structures that contain a significant volume proportion filled with air. That is, the extended three-dimensional structures comprise hollow regions at least partially bounded by tiles. For purposes of this disclosure, at least two tiles of an assembly must be connected at an angle relative to each other that is neither 0 degrees nor 180 degrees in order to form a three-dimensional structure having a hollow region. These elements may be characterized as having an "areal density", "surface density" or "planar density" determined by taking the mass of the tile divided by the area bounded by its perimeter. The perimeter is the outermost extent of the tile in the plane of its length and width. A planar structure does not have to remain flat. That is, a planar structure for the purposes of this disclosure may also include portions of a thin-walled cylinder or saddle structure that can be formed from a flat planar structure.

As used herein for the purposes of this disclosure, the term "flexible film" should be interpreted as a planar material with thickness less than 0.4 mm that has relatively low resistance to bending. "Rigid films" may generally be made of the same material as a flexible film, but are more resistant to bending due to their generally thicker nature.

As used herein for the purposes of this disclosure, the terms "to affix" and "to attach" one element to another element should be interpreted as resulting in some restriction in the relative motion of the elements. The restriction in motion may be temporary and/or reversible in nature and may result from causes comprising magnetic attraction, adhesive or thermal bonding, or mechanical engagement. An element may be affixed to another element and still have some range of free movement in one or more dimensions. For example, an element may move in three dimensions while affixed within a cavity sized to prevent movement of the element outside of the cavity. Direct physical contact between elements is not required for one to be affixed to the other.

Other terms in the specification and claims of this application should be interpreted using generally accepted, common meanings qualified by any contextual language where they are used.

DETAILED DESCRIPTION

In some embodiments, the planar magnetic construction tile methods and systems provided in this disclosure utilize permanent plastic magnets located at the periphery of a planar core member. Plastic magnets have the advantage of typically requiring only simple processing after fabrication since they may be formed by extrusion, calendaring or molding of permanent magnetic particles mixed with a polymeric binder. Depending upon the binder, plastic magnets may be easily cut with blade tools, punches and dies. Other magnet types often require abrasive sawing and grinding to final shape. The binder in a plastic magnet also act as an encapsulant on the permanent magnet particles which eliminates the need for coating or plating operations that are used to protect magnets made only of rare earth magnetic material. The magnetic flux density and magnetic energy product characteristics of plastic magnets, however, are lower than those for magnets made only from the magnetic filler. Since these characteristics contribute to the holding power of a magnet, plastic magnets generally provide weaker magnetic holding and reaching forces which have previously restricted their use in three-dimensional construction toys to those where magnetic forces from each magnet act only in one direction. Using planar tiles to create three-dimensional structures requires that tiles may be assembled to one another in multiple directions, which suggests that plastic magnets are a poor choice with prior art approaches. With some of the embodiments provided in this disclosure, however, creating stable three-dimensional assemblies using planar construction systems with plastic magnets is possible. Due to the low magnetic force and mechanical flexibility of some plastic magnets, toy safety may be improved over the use of higher magnetic field strength, more rigid or brittle magnets. A number of examples of planar construction tiles that may include plastic magnets are described below. These descriptions are not meant to be restrictive of the general inventive concept disclosed, only to provide illustrations of how the inventive concept may be employed.

The following descriptions includes terms such as upper, lower, first, second, etc. that are used for descriptive purposes only, and they are not to be construed as limiting. References will now be made to the drawings wherein like structures will be provided with like reference designations. In order to show the structures of embodiments most clearly, the drawings included herein are diagrammatic representations of inventive articles and systems. Thus the actual appearance of the structures and systems may appear different while still incorporating the essential structures of embodiments. Moreover, the drawings show the structures necessary to understand the embodiments. Additional structures known in the art have not been included to maintain the clarity of the drawings.

Figure 1:
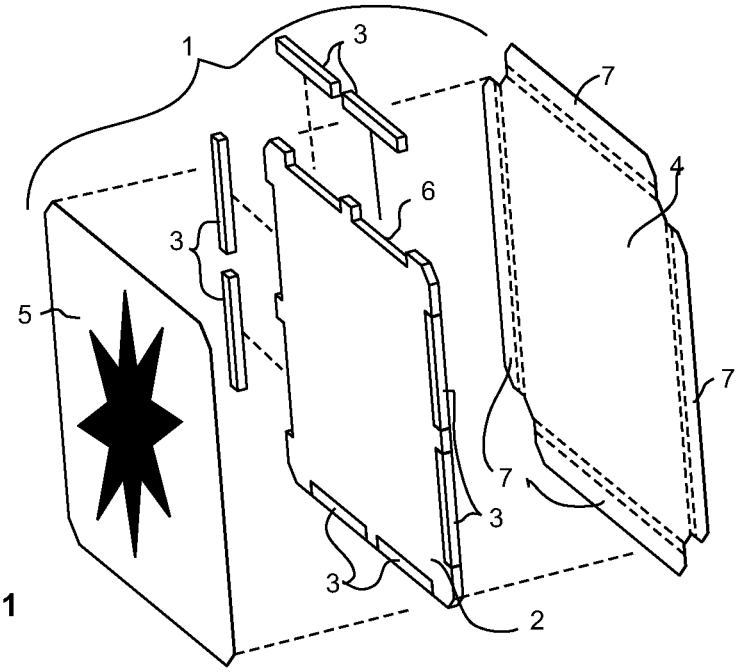
FIG. 1 is a schematic view of a planar magnetic construction tile according to an embodiment.

Referring to FIG. 1, for the purposes of discussion, this example depicts a perspective exploded view of a magnetic construction tile 1 with a core layer 2, peripheral magnets 3, rear facing 4 and front facing 5. The core layer 2 may be constructed of a variety of paper family sheet materials such as recycled paper, pulp board, chip board, or cardboard, polymeric sheet or molded polymers, non-magnetic metal foils, textiles or combinations of any of these or other materials with similar properties. Polystyrene foam is a preferred core material offering low weight and mechanical toughness. These core materials generally have the advantage of low cost and compatibility with high-volume printing and lamination processes. The core may contain magnet recesses or notches 6 for ease of positioning magnets. Other functional or decorative elements may be included in the core including cutouts, honeycomb or corrugation features or embossments. For example, these or other structural elements known in the panel fabrication arts may be used to enhance or lessen rigidity or decrease areal density.

The magnets may be captured by a portion or portions of the facings. FIG. 1 shows one facing 4 that covers the back planar side of the core and also includes tabs 7 that wrap around three sides of each magnet 3. A second facing 5 partially overlaps the tabs and covers the front planar side of the core. As shown, the back facing decorates the back of the tile and captures the magnets in the core recesses.

Facings may be made from a variety of paper and polymeric film products known to those skilled in the packaging, printing and converting arts. The side of the facing towards the core may be coated with a pressure-sensitive adhesive to affix the facing and the magnets to the core. The facing may be attached to any other element of the tile including itself through ultrasonic bonding, heat staking or other mechanical or chemical attachment methods compatible with the materials used.

In the illustrated embodiment, magnets 3 may be relatively low-strength plastic magnet material. In particular, ferrite magnet particles in a polymeric binder provide plastic magnets with residual flux densities of approximately 1600 to 2200 gauss, with an energy product of 0.6 to 1.1 MGOe.

Figure 2:
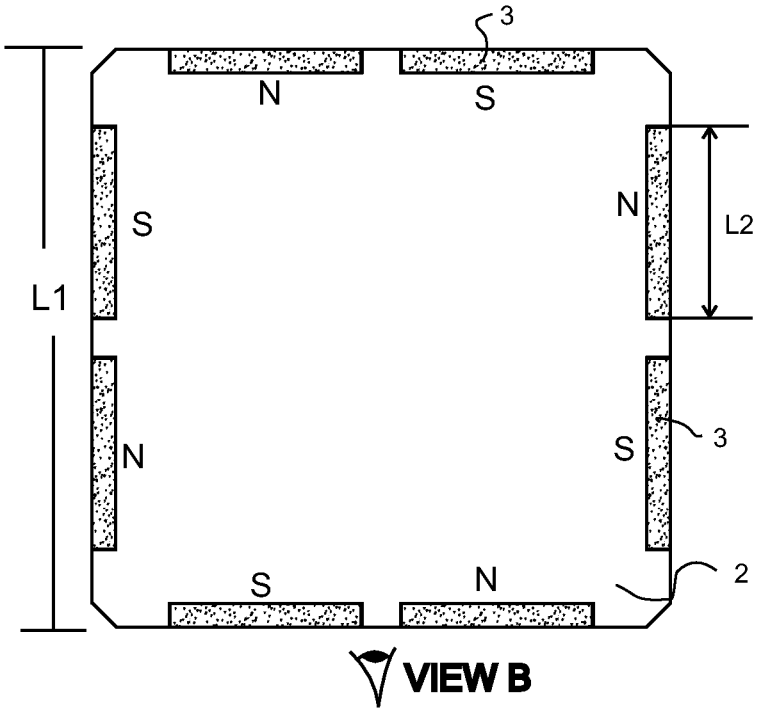
FIG. 2 is a top view of the tile core and fixed edge magnets of FIG. 1.
Figure 2A:
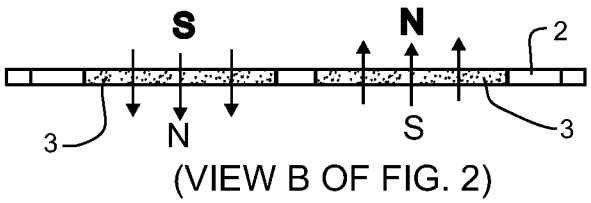
FIG. 2A is a side view of one edge of the elements shown in FIG. 2.

As shown in FIGS. 2 and 2A, the magnetic poles are preferably arranged such that the north (N) and south (S) poles 8 are oriented perpendicular to the face of the core 2. For inter-tile connection flexibility, the magnets may alternate their polarity as illustrated. The same alternating polarity and magnet size and spacing are preferred for construction sets having a single tile shape whether the shape is a square, triangle, rectangle, hexagon, or other shape with an axis of symmetry to provide edge connection flexibility when tiles are flipped or rotated. In construction sets with more than a single tile shape or size, maintaining this alternating polarity and magnet size and spacing along each mating edge or as a multiple of the edge length with multiple sets of magnets is preferred. For example in a rectangle with parallel edges L1 and 2 times L1 in length, if the longer edges contain two pairs of magnets, then two squares of side length L1 may be attached to the long side of the rectangle. With weaker plastic magnets, it is preferred to have the magnets extend for a majority of a connecting edge length of a tile for alignment and total attractive force reasons. The magnets in this figure are simple hexahedrons with a length, L2, substantially longer than the width and thickness. The magnets can also be shaped to provide mechanical interlocking with the core using dovetail or other complimentary interlocking shapes in the magnet and core. Since the plastic magnets and cores can be easily die-cut, costs of adding mechanical interlocking features is reduced over that of other magnet types requiring sawing or grinding.

Figure 3:
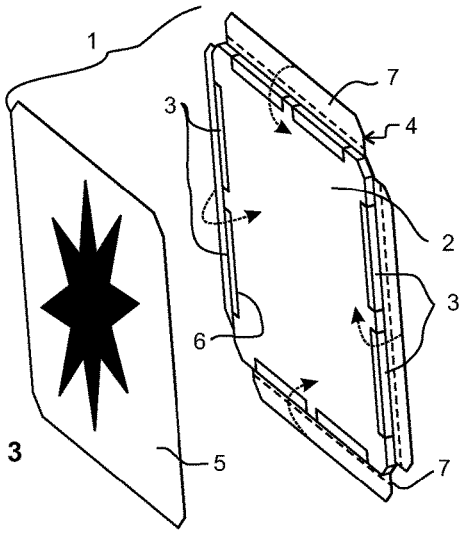
FIG. 3 is a schematic view of the planar magnetic construction tile at a higher level of assembly.
Figure 4:
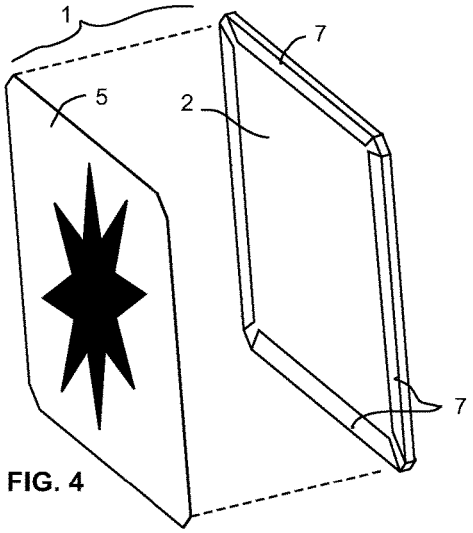
FIG. 4 is a schematic view of the planar magnetic construction tile at a higher level of assembly.
Figure 5:
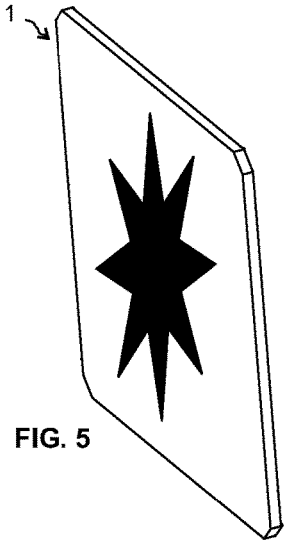
FIG. 5 is a schematic view of the planar magnetic construction tile at a higher level of assembly.

Referring to FIG. 3, tabbed rear facing 4 is assembled as indicated by arrows onto the core 2 with magnets 3 positioned in the substrate notches 6, with the magnets being substantially flush with the outer surfaces of the core. Tabs 7 are shown after folding over the magnets onto core in FIG. 4. In FIG. 5 front facing 5 is applied over the tabs. In concert with the core notch, the magnets are thus securely entrapped in all directions by the facing materials and adhesive bonding used during assembly of the tile.

Any combination of facing elements that provide a decorative and/or functional characteristic may be used. The exact shape, materials and assembly sequence may be varied. For example, both facings may contain tabs, or one or both of the facings extending over the central area of the core may be omitted and only tabbed sections utilized to retain the magnets. That is, the tabs that wrap around the magnets may be discrete pieces that do not extend substantially beyond the notched area of the core. Alternatively, the two facings shown can be integrated into a single piece. The tabs shown in FIG. 3 are sized to wrap around three sides of each magnet. Alternatively, individual tabs may only contact the magnets over a portion of each side in the plane of the tile so that the edge surface of each magnet and core is not covered by the facing.

Plastic magnet material may be inserted into recesses punched into a larger sheet of core material, trapped with flat facings on both sides and then a plurality of magnets and tiles die cut to final shape having no wrapping of facings around the thickness edges of the completed tile. Magnetizing tiles after separation is preferable in this case. A variety of other assembly methods and materials are available in the high-volume printing, packaging and converting industry that may be used to fabricate or decorate the cores, facings or assembled tiles. The facings may contain a variety of cutout shapes and openings. The facing material may be textured or coated to modify the friction between tiles. Magnets may also be wrapped with a decorative film or paper prior to lamination or assembly onto a core.

When plastic magnets are used, the rigidity, mechanical strength and thickness requirements of the facing or the core may be lessened compared to conventional magnetic construction toys that use (non-bonded) rigid ceramic ferrite, alnico or rare earth magnets. The low magnetic fields of ferrite plastic magnets reduce the potential danger from the ingestion of multiple magnets creating blockages or pinching of membranes in a child's digestive tract. Commercially available building tiles generally contain magnets with higher magnetic field strength trapped within an injection molded plastic shell. The danger of swallowing magnets is reduced if the magnets cannot escape from the tiles if the tiles are too large to swallow. Ceramic ferrite magnets are generally brittle, so retention within a rigid plastic tile helps prevent magnet breakage and exposure to sharp fracture edges. As a result, there is a practical minimum plastic wall thickness of typically 0.4 to 0.6 mm when using these stronger magnets in toy construction tiles. The magnetic properties must be sufficiently high to overcome this separation distance between magnets when construction tiles are assembled.

The loose plastic magnets may have sufficiently weak attractive forces and/or be of a length that is accepted to not pose a small parts swallowing danger. In addition, plastic magnets may be securely affixed to a construction tile core with adhesive coated polymer films that are about 0.1 mm thick or less. The mechanical strength requirements of the core necessary to prevent release of a plastic magnet are also typically reduced. In the case of a tile assembly as shown in FIG. 5, incorporating a rigid magnet, a stiff the magnet would resist bending caused by holding a magnet and pulling up on an adjacent edge of a tile. This would result in a torque from the magnet acting to separate the facing from the tile and degrading the magnet entrapment. Under some conditions, the magnet could break exposing sharp edges. In contrast to this, if a flexible plastic magnet is used, this torque will be negligible if the flexible magnet and tile have similar flexibility. Bending the tile causes the magnet to bend. Flexible plastic magnets are available with a minimum bend radius of 8 times their thickness and durometers of approximately less than Shore A 50 to Shore D 80. Plastic magnets can also be produced by extrusion in essentially continuous one-dimensional forms that are not practical with other magnet technologies. Thus, the length, L2, of each of the two plastic magnets along each edge of the tile 1 as shown in FIG. 2 can be up to one-half of L1 in length, no matter how big L1 becomes.

Since magnetic attractive forces depend strongly upon separation distance, using the thinnest magnet covering able to meet other mechanical requirements is generally preferred. Paper or film facing layers covering the flexible plastic magnets in this embodiment may be approximately 0.02 to 0.15 mm thick for good performance building extended three-dimensional structures. The thin facing layer, combined with lightweight core materials, complement the characteristics of low-magnetic strength, and low-costs, of safe ferrite-based plastic magnet materials in this embodiment. Additionally, the core material with facings produces a sufficiently stiff, lightweight assembly to build extended three-dimensional structures with these weak magnets.

Prototype 7.5 cm×7.5 cm square tile have been constructed utilizing 2 mm paper pulp board core material, 0.08 mm thick tabbed and non-tabbed vinyl facings, and plastic magnets with 2.3 mm×3.0 mm rectangular cross-section and 2.5 cm lengths characterized by an energy product in the range of 0.6 to 1.1 MGOe. This construction produced a tile (similar to FIG. 1) set with a weight of approximately 10 grams each, with a pull force of 85 grams parallel and 70 grams perpendicular to the faces of adjacent tiles. Substituting foamed polystyrene for the pulp-board core material allows the tile weight of this size to be constructed with a weight of only 5 grams. These prototype tiles have a planar area density in the range of 0.1-0.2 grams per square centimeter. Since the polystyrene foam also does not delaminate with bending and does not absorb moisture, it is preferred core material for performance. In contrast, prior art toy construction tiles having a 7.5 cm×7.5 cm molded plastic body with ceramic ferrite magnets captured in the edges are approximately 6.4 mm thick and weigh about 30 grams. Even though ceramic ferrite magnets are less dense than their ferrite plastic magnet counterparts, the resulting planar area density of these tiles is over 0.5 grams per square centimeter.

Figure 33:
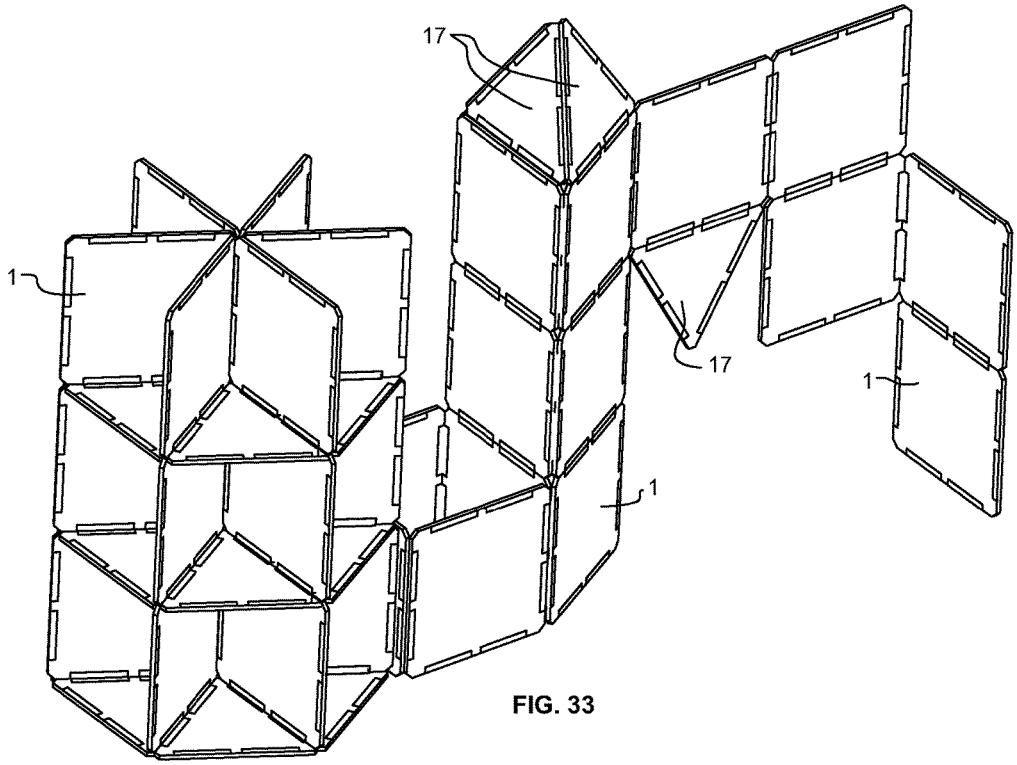
FIG. 33 is a schematic view of an extended three-dimensional structure comprised of planar magnetic building elements.

The physical and mechanical characteristics including dimensional ratios of the various elements comprising the planar magnetic tiles are important considerations in balancing tradeoffs for building extended three-dimensional structures. This is particularly important in providing adequate connection forces between tiles having weak magnets. In general, it is possible to calculate the magnetic flux density with the use of mathematical modeling including finite element analysis and then confirm the model with measured comparisons. Typically, the geometries that are modeled are simple and limited in relative spatial orientations. In building extended three-dimensional constructions as illustrated in FIG. 33 using planar tiles, tiles typically must be attached to one another over a range of different angles and with different numbers of tiles at intersections. Magnetic poles will generally not be symmetrically aligned with the north pole directly opposite the south pole of an adjacent tile's magnet, but may be oriented at right angles to each other for rectangular tiles, or parallel yet displaced a distance perpendicular to the pole directions. It may be advantageous in building stable larger assemblies of tiles to fabricate subassemblies of multiple tiles and then join the subassemblies together rather than adding one tile at a time to increase the size of the system. As the local magnetic flux density is a vector quantity sensitive to shape, size and edge effects, the amount of mathematical modeling and verification to qualify the models with plastic magnets may be impractical. Through experimentation of attractive force strengths at different angles and geometries with weak plastic magnets, we have discovered that there are certain geometric characteristics that provide relatively uniform forces of attraction as a function of angle, consistent geometric orientation at joints and increased forces of attraction when the number of tiles joined by their edges at a common interface is increased. These will be discussed below.

Figure 6:
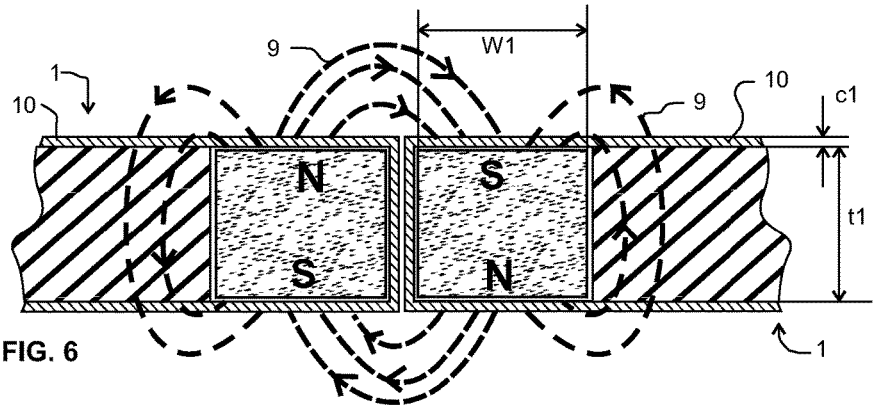
FIG. 6 is a partial cross-sectional view of two planar magnetic tiles connected at an angle of 180 degrees.

FIG. 6 is a cross-sectional view through the magnets of two magnetic tiles 1 of the embodiment of FIG. 1 that are connected at a relative angle of 180 degrees. The magnets each have a length, L2, that is perpendicular to the cross-section and a polar width, W1, that extends horizontally and a thickness, t1, in the vertical direction. The thickness of the magnets, as shown, is substantially the same as the thickness of the core. This provides a flat interface for the facing of thickness, c1, that covers the core and the magnet, but the magnet and tile may have different thicknesses from each other. The covering on each tile creates a separation of the two tiles along the vertical edge interface equal to twice the facing thickness, 2 times c1. Magnetic flux paths 9 are symmetrical in this configuration about the horizontal centerline due to the symmetry in the connection geometry. The flux lines exit perpendicular to the north pole of one magnet and fringe to the adjacent south pole of the other magnet through the air or to the south pole of the same magnet through the core as indicated schematically. The density of the flux lines bridging from one magnet to the other contribute to the magnetic force of attraction, and these are generally higher at the corners of the magnets. Around the centerline position between magnets, the flux density will be essentially zero with the poles oriented as shown. The flux lines that pass through the core between poles of a single magnet do not contribute to the force holding the tiles together.

Figure 7:
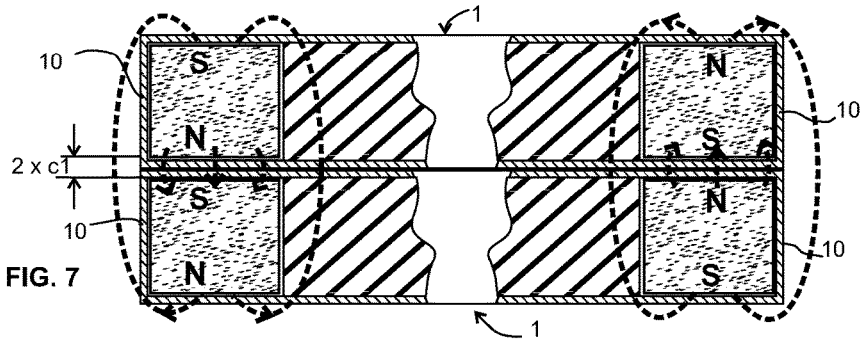
FIG. 7 is a partial cross-sectional view of two planar magnetic tiles connected at an angle of 0 degrees.

FIG. 7 is a partial cross-sectional view of two planar magnetic tiles 1 connected at 0 degrees, that is, stacked. In this configuration, opposite magnetic poles of the two tiles are directly opposite one another and separated by twice the thickness of the facing, or 2 times c1. In this more typical aligned magnetic pole configuration, the flux lines are directed vertically through the thickness of the magnets and facings and then fringe from the outer most pole surfaces through the air or through the two cores. Since the magnetic permeability of the core is about the same as that of air, the flux lines are shown as symmetrical. This stacked configuration is not particularly useful for building extended three-dimensional structures from thin tiles, although it may be beneficial for storage of tiles. The alternating poles and fixed positioning of the magnets in the cores as indicated in FIG. 2 ensures that like tiles will stack in this manner no matter how tiles or oriented or if two subassembly stacks are joined. The relatively high magnetic attractive forces from this geometry may be a problem for young children with strong magnets in being able to separate stacks of tile if the total attractive force exceeds approximately 400 grams; however the core may be slightly thicker than the magnets, or include features to slightly separate the poles when stacked in this configuration in order to reduce required separation force.

Figure 8A:
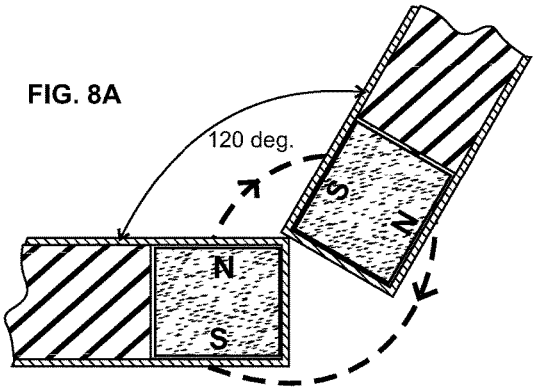
FIG. 8A is a partial cross-sectional view of two planar magnetic tiles connected at an obtuse angle.
Figure 9A:
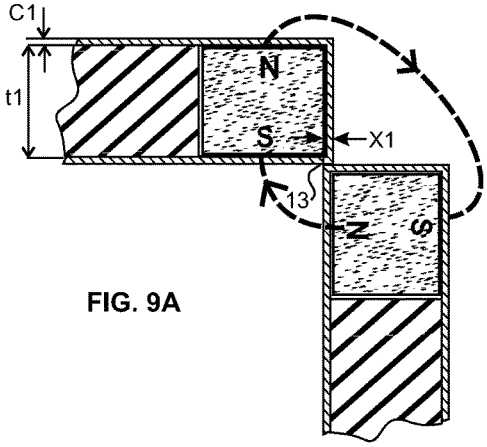
FIG. 9A is a partial cross-sectional view of two planar magnetic tiles with thin facings connected at an angle of 90 degrees.
Figure 9B:
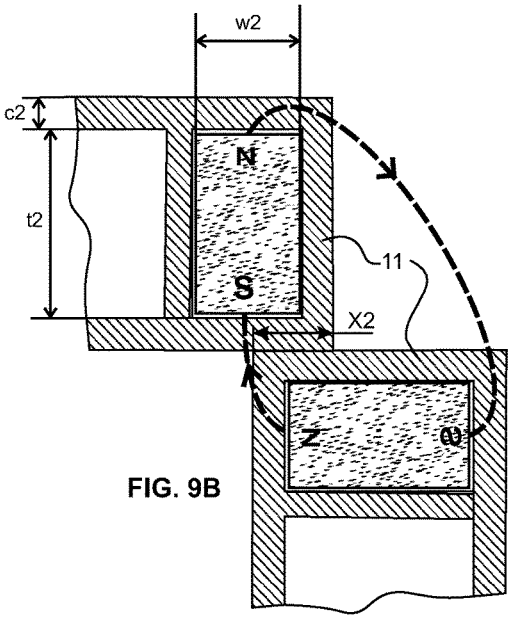
FIG. 9B is a partial cross-sectional view of two planar magnetic tiles with thick facings connected at an angle of 90 degrees.

FIG. 8A shows a cross-sectional view of two tiles that intersect at an angle of more than 90 degrees. As the angle is decreased from 180 degrees of the tiles as shown in FIG. 6, one tile pivots up relative to the other one. As this occurs, the flux lines that were between the tiles at the top have a shortened path length relative to the increased path connecting the other poles. The shorter paths contribute more attractive force holding the tiles together than do the longer paths. The 90 degree orientation is important for constructing hollow cubes or rectangular hexahedrons. As the tiles are rotated relative to one another the pivot point generally shifts under magnetic force in the vicinity of the 90 degree point. The amount of this shift and the consistency of this shift appear to be functions of the magnetic characteristics of the magnet, the ratio of the magnet width to thickness, the thickness of the facing and the weight of the tile. With relatively weak plastic magnets, keeping the thickness of the facing less than about 0.2 mm appears to be very important for consistency with magnets that are on the order of 2 mm thick and tile weight of up to about 12 grams for a 7.5 cm square tile. This is illustrated in FIG. 9A for a tile with thin facings 10. In this case, the offset, X1, is typically in the range of c1 to twice c1. Thicker coverings 11 (See FIG. 9B) and thicker, heavier tiles do not appear to work as well for fabricating subassemblies that can be easily handled. For example, tiles with ceramic magnets 5 mm thick with a rigid facing thickness, c2, of 0.5 mm and a weight of 30 grams exhibit higher offset, X2. X2 is typically about 2.4 times c2.

This larger offset appears to complicate the handling and attachment of subassemblies into larger extended three-dimensional structures.

Figure 8B:
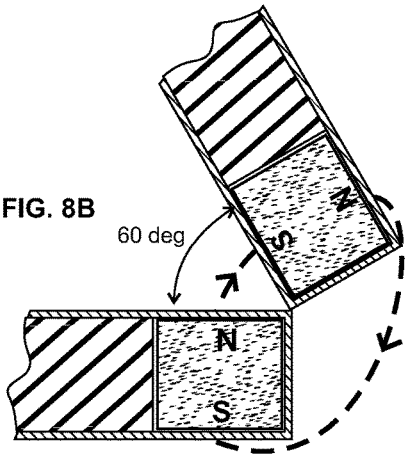
FIG. 8B is a partial cross-sectional view of two planar magnetic tiles connected at an acute angle.

As the angle between tiles is reduced further (FIG. 8B), the flux paths at the acute angle between the facing poles are much shorter than the flux paths connecting the other two poles away from the corners. The attractive force comes principally from the shorter paths. As the angle approaches zero, the offset declines until it disappears at zero degrees. For tiles that are isosceles triangles, approximately 70 degrees is a critical angle for forming hollow tetrahedron subassemblies. Keeping the covering thickness less than 0.2 mm with a 2 mm thick magnet also appears to be important for handling strength with these tetrahedron subassemblies.

The discussion above regarding flux lines was based on general principles of magnetic fields and observation of prototype constructions. These hypotheses were presented only to provide a perspective on the basic mechanisms that are believed to be responsible for providing the functional benefits over the range of conditions appropriate for magnetic building tiles. Determination of the actual magnetic flux densities in space to verify this perspective for the specific systems disclosed has not been done. Verification of the flux line perspective provided is not essential to use the inventive concepts of this disclosure, and the application of the inventive concepts is not dependent upon the accuracy or completeness of these hypothetical perspectives. Representative test results that show the dependence upon key factors that influence functionality in building extended three-dimensional structures will be provided below.

In general, higher magnetic attractive forces result from larger magnets. In the case of magnetic tile construction toys, the increased weight from increased magnet size must be considered since this will influence how high a structure can be built or how many tiles may be held in a cantilevered position or otherwise suspended. Under a limited range of geometric and core characteristic configurations, weak plastic magnets can provide sufficient functionality in building extended three-dimensional structures to entertain children.

Figure 10:
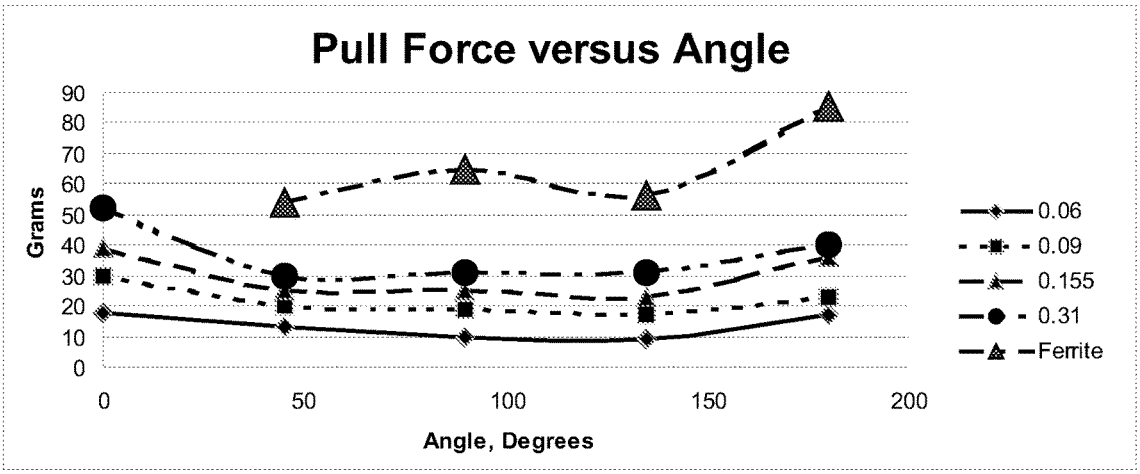
FIG. 10 is a representative graph of pull force versus angle between tiles of different magnet cross-sectional profiles.

FIG. 10 provides test data on the impact of changing the width of the polar face width, w1, of a pair of identical plastic magnets oriented over a range of angles defined as shown in FIGS. 6-9 above. For all data points, the t1=2.5 mm thickness of the magnets, the L2=2.5 cm length of the magnets, and the c1=0.08 mm facing thickness were fixed. The plastic magnet was specified to have a maximum energy product of 1.1 MGOe and a residual flux density of 2200 gauss. The polar face width, w1, was varied from 1.5 to 7.9 mm. (For comparison, data for a commercially available magnetic tile with a ceramic ferrite magnet are included.) For building extended 3-D structures, the pull force or magnetic attraction at 0 degrees is much less important than that at other angles. As shown by the curves, the measured pull forces between 45 degrees and 135 degrees are relatively stable for each pole width tested, but were less than the pull strength at 180 degrees and 0 degrees. As expected, the pull force at 0 degrees increases as the pole area increases, but the observed increases are not strictly proportional to area. This is attributed to fringing field effects in the tested magnet and separation geometries.

Figure 11:
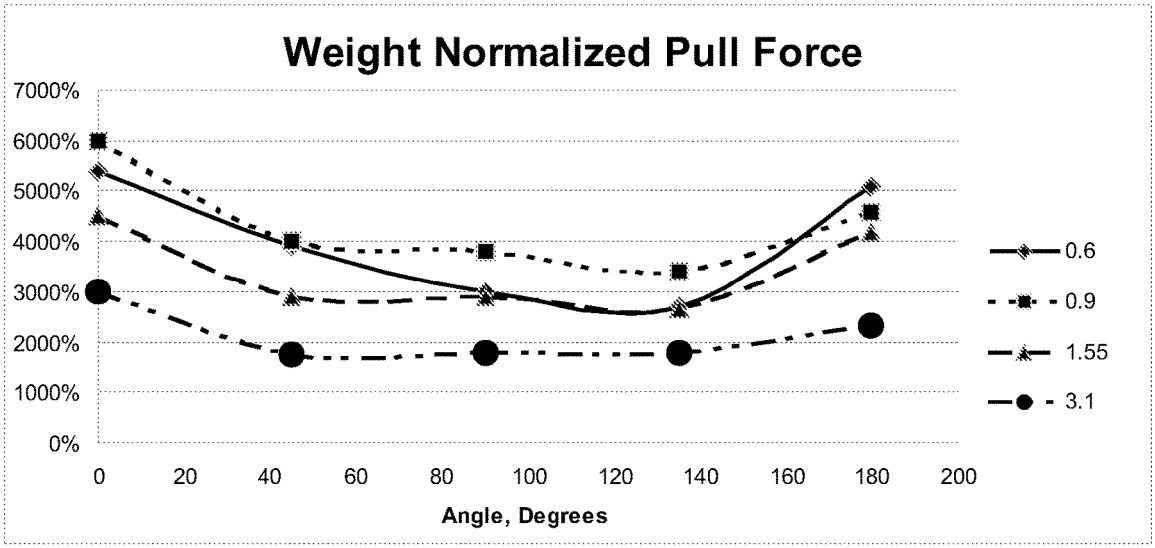
FIG. 11 is a representative graph of pull force versus angle normalized by magnet mass.

Adding weight with larger magnets should be avoided if there is not a commensurate increase in attractive force at the angles of interest for constructing extended 3-dimensional structures. FIG. 11 takes the data from FIG. 10 and normalizes it by the weight of the magnet to provide a relative magnetic force efficiency measure for a particular magnetic material. From this, the magnetic efficiency with the plastic magnets under these test conditions is highest in the range of angles from 45 degrees to 135 degrees for the cross-section with a polar width to thickness ratio of 90%. The least effective profile measured was 310%, even though this had the highest raw pull force data at all angles measured of any profile.

Figure 12:
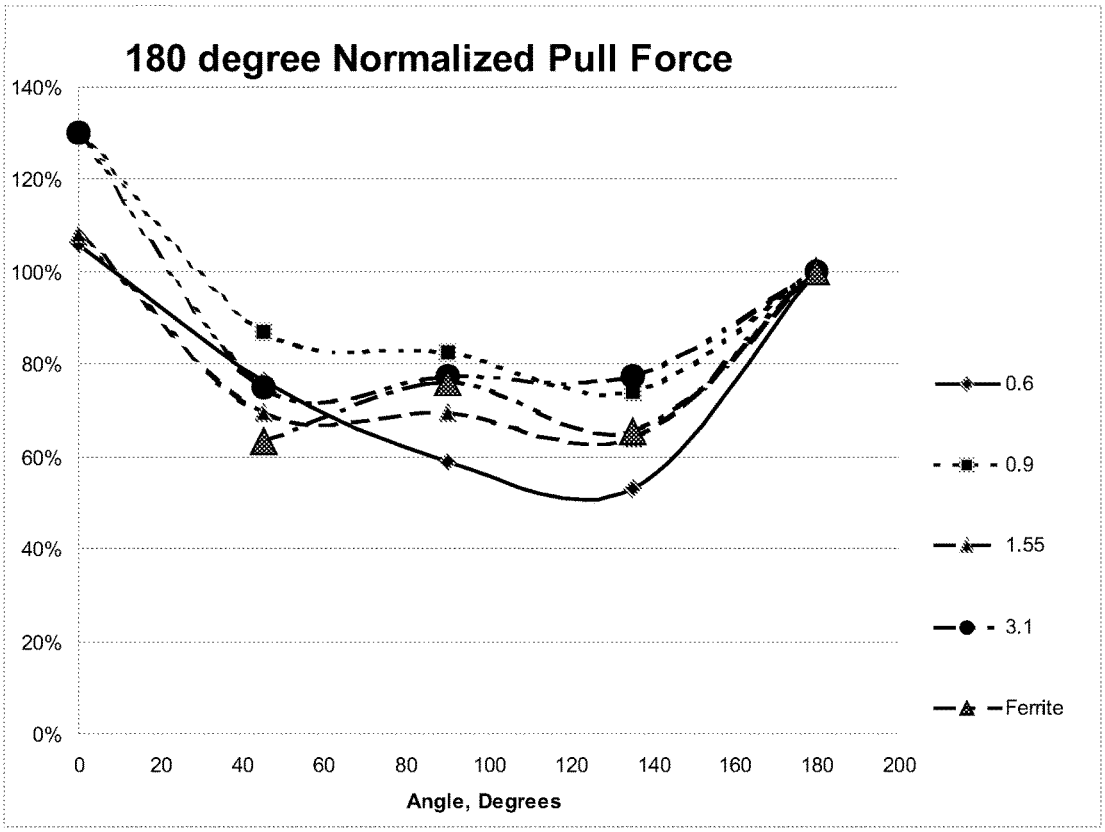
FIG. 12 is a representative graph of pull force versus angle normalized to pull force at 180 degrees.

After a predetermined minimum force is achieved, the uniformity of attractive force over the angles of interest for tiles is also an important consideration. The minimum forces can be predetermined from test structures and normalized by total tile weight. For example, the ability to suspend a chain of 5 square tiles from a construction set may be used as such a minimum force requirement that is also easily tested. Such a hanging configuration is based upon the pull strength at 180 degrees. FIG. 12 presents representative pull force data at different angles relative to the values obtained for each case at 180 degrees. These curves provide some relative measure of the reduction and variation in pull force by angle. As was the case for the weight normalized efficiency measure, these curves show the effect of profile shape with this plastic magnet material on the uniformity of pull forces. The ceramic ferrite magnet included for reference in FIGS. 10 and 12 had a width to thickness ratio of 60%, but the curve is a different shape from the plastic magnet with substantially the same profile. At the measured angles of 45, 90 and 135 degrees, the plastic magnet with 90% width to thickness profile has the consistently highest uniformity by this measure.

The thinner tiles and facings of the embodiments of this disclosure provide tighter packing of multiple tiles joined at their edges at a vertex. Adding more tiles to a junction vertex provides increasingly higher and more predictable attractive forces than is possible with thicker facings needed to contain stronger fixed magnets safely. Adding another tile to intercept the longer flux paths shown in FIGS. 6-9 effectively shortens the path length, increasing the flux density magnitude and increasing the magnetic attraction of each tile to each other along their common interface. The edges of thinner tiles may be packed together more closely at a vertex, and thinner facings decrease the distance between magnets. For 2 mm thick prototype tiles using plastic magnets, the pull strength for a tile at 90 degrees to two other tiles joined at zero degrees has an attractive force that was measured to be approximately 90 percent more than the attractive force measured when it was attached at 90 degrees to just one other tile. Further, in a larger sub-assembly of tiles forming a segmented half hexagon from triangular sections, the force holding a tile to the central axis is increased by over 50% when the half segment is completed. In this case, the number of tiles forming a junction vertex with 60 degree angle spacings increased from three to four tiles.

Figure 34:
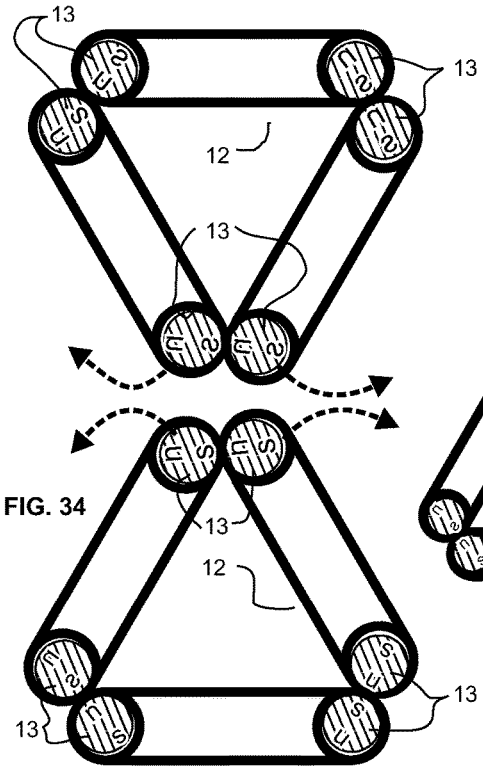
FIG. 34 is a cross-sectional view of the repulsion of two subassemblies formed with prior art tiles with rotating magnets.
Figure 35:
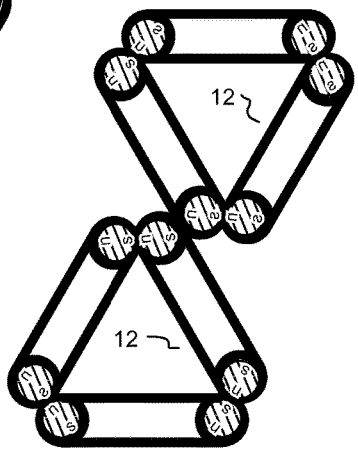
FIG. 35 is a cross-sectional view of one of the attachment configurations for the subassemblies of FIG. 34.
Figure 36:
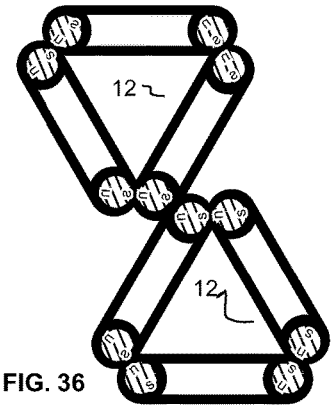
FIG. 36 is a cross-sectional view of an alternate attachment configuration for the subassemblies of FIG. 34.

With prior art rotating, radially magnetized, cylindrical or spherical magnets designed to dynamically orient poles in different magnets to optimize attractive force, the flux paths are optimized independent of relative angle as a pair of freely rotating magnets are brought together. In this case, the improvement in attractive force from 3 loose magnets versus two at a junction was measured to be less than 20%. As noted earlier, prior art rotating magnets in planar tiles do not always reorient after they are attached to the first other tile. As a result, edges of subassemblies formed by two tiles may repulse an edge of another subassembly at the junction if the magnet pairs in the subassemblies do not reorient. The repulsion of triangular subassemblies 12 with rotating magnets 13 is illustrated in the cross-sectional view in FIG. 34. Each of the triangular subassemblies is easily assembled since in each stage of assembly, one new magnet is added to a connection. A freely rotating magnet that is added last to a junction reorients to align with the previously affixed magnets. When magnets become oriented in building a subassembly, friction or greater distances to other magnets in a junction may prevent magnets already joined in a subassembly from further reorienting. That is, the poles may become "frozen" in position by magnetic forces during the subassembly construction and do not reorient when another subassembly is brought near. This fixed magnetic orientation in subassemblies can result in repulsive forces when subassemblies are brought together as illustrated in FIG. 34. In this case, the stable attachment positions of the two subassemblies are shifted to one side or the other as shown in FIGS. 35 and 36. The subassemblies in this case will attach such that two junctions are formed separated by a distance of approximately two tile thicknesses. This offset results in unpredictable attachment and misalignment of subassemblies when trying to form extended three-dimensional structures such as that illustrated in FIG. 33.

Figure 13A:
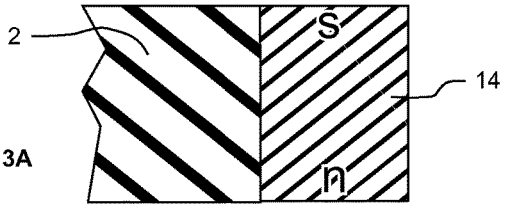
FIG. 13A is a partial cross-section of a full rectangular magnet cross-section.
Figure 13B:
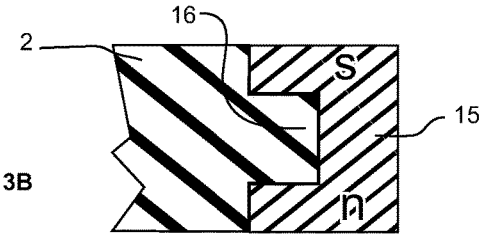
FIG. 13B is a partial cross-section of a U-shaped magnet cross-section.
Figure 13C:
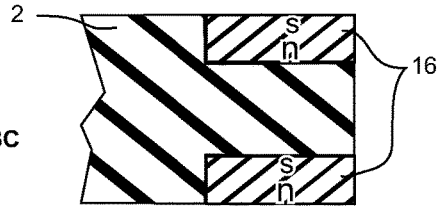
FIG. 13C is a partial cross-section of a parallel beam magnet cross-section.
Figure 14A:
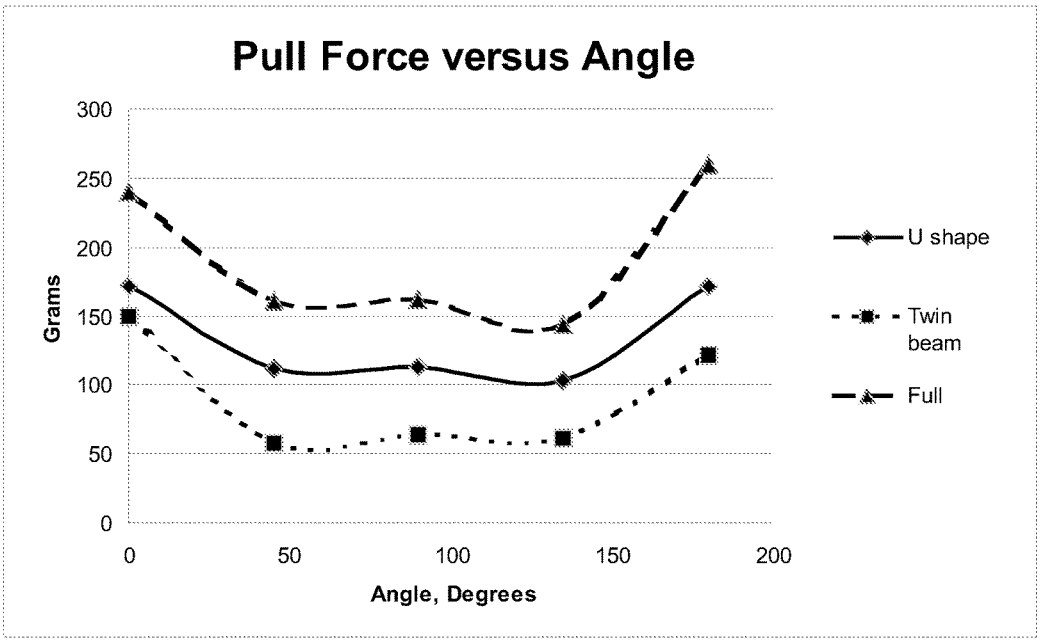
FIG. 14A is a representative graph of pull force versus angle of the magnet geometries of FIGS. 13A, 13B, and 13C.
Figure 14B:
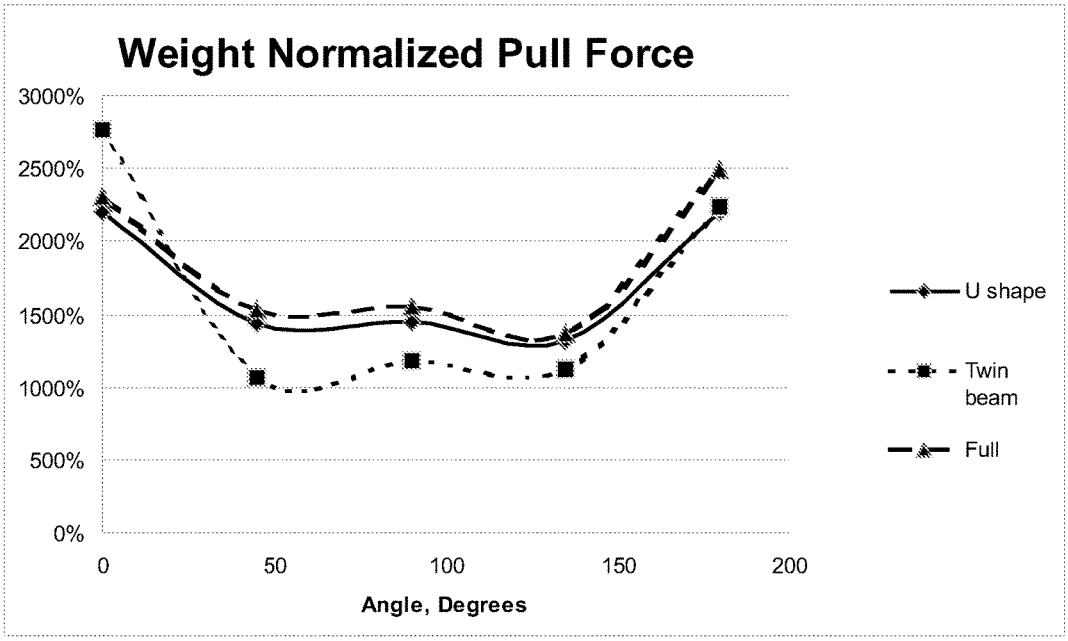
FIG. 14B is a representative graph of pull force versus angle of the magnet geometries of FIGS. 13A, 13B and 13C normalized by weight.
Figure 14C:
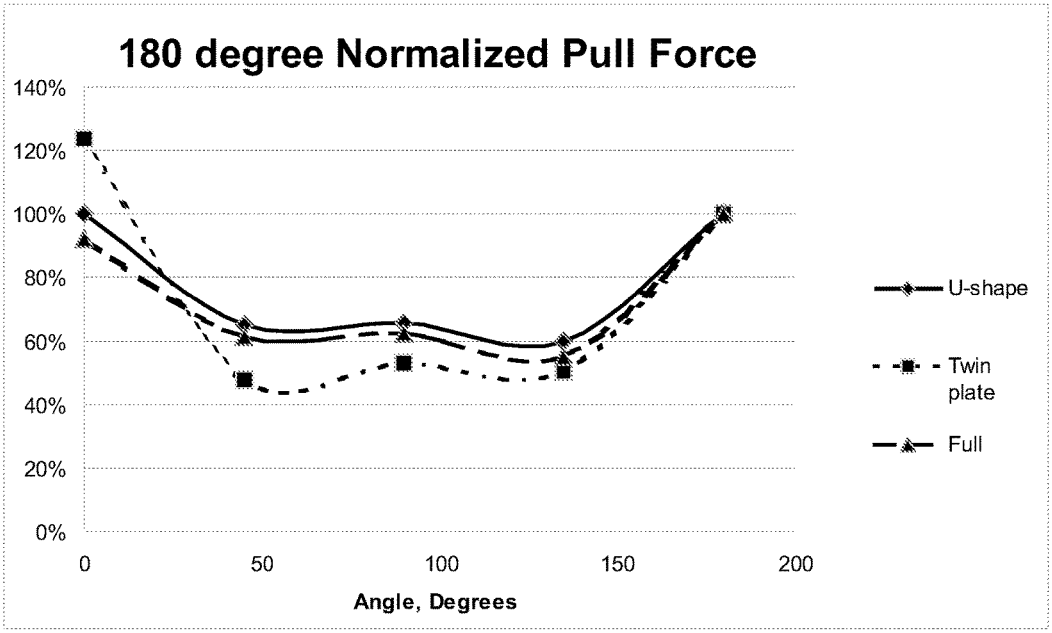
FIG. 14C is a representative graph of pull force versus angle of the magnet geometries of FIGS. 13A, 13B and 13C normalized to pull force at 180 degrees.

A variation of the embodiment discussed previously above employs a profile which removes less efficient magnetic material. From the curves of the pull strength as a function pole width, the benefit of adding additional magnetic material in a direction towards the interior of the core diminishes at some point in the range of 1 or 2 times the thickness of the magnet. The corners of the magnets at the outer top and bottom edges of the planar construction elements appear to provide a higher contribution to the effective attractive force than the magnet material at other places. FIG. 13A shows a rectangular cross section magnet 14 and FIGS. 13B and 13C shows two profiles where the overall x-y cross-section extents are preserved while slices of the center of the interior edge was removed from the full rectangular profile of FIG. 13A to form a groove which creates the "U-channel" profile magnet 15 of FIG. 13B. Extending the groove further to the exterior edge results in the "Twin beam" magnet profile 16 configuration shown in FIG. 13C. By using layers of the same plastic magnet material for the tests above, a composite magnet was assembled that was 4 times as thick (10.2 mm) as the thickness above and used the maximum width of 7.9 mm tested above and was 50% longer at 38.1 mm. No facing was used with these larger composite magnets. Referring to FIGS. 14A and 14B, in the range of angles between 45 degrees and 135 degrees, the U-shaped profile had 70% to 90% higher raw pull force and higher weight normalized pull force than the twin beam profile. The U-shaped profile also had comparable angular dependence to the full profile as shown in FIG. 14C.

As expected from a larger magnet with no facing layer, the pull forces in FIG. 14A are larger than those in FIG. 10. However, from a weight normalized comparison of FIG. 11 and FIG. 14B, the smaller magnets are more efficient around 90 degrees. With low density core materials such as polystyrene foam, the density and volume of the magnets contribute a majority of the areal density of a tile. Plastic magnets that are a few millimeters in width and thickness are preferred for lightweight building tiles.

The 180 degree normalized and weight normalized efficiencies were also higher with the U-channel than the twin beam shape. Note that the normalized curves for the solid shape are about the same as the U-shaped data.

Creating more complicated profiles typically increases the cost of non-plastic magnets. Since plastic magnets may be extruded, profiles with rectangular, triangular or other shaped grooves may result in materials savings costs with reduced weight. The groove may include features that provide mechanical locking or alignment features for attachment to the core as an alternative to the facing attachment illustrated in FIGS. 1-5. Whether the groove is left empty or filled with core material, the density of a core made from polystyrene foam is an order or magnitude less than the density of most plastic magnet materials.

Figure 15:
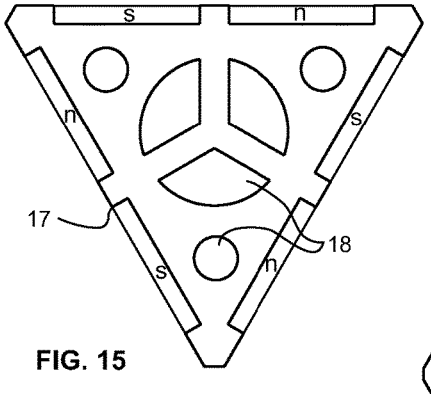
FIG. 15 is a schematic illustration of a triangular planar magnetic tile with voids.

In addition to the square construction tile described in embodiments above, other shapes in a set of magnetic construction tiles are possible. FIG. 15 shows a triangular tile 17 as an example. If the magnet size and spacing is the same as the square tile, then the triangular tile can be attached to a square tile to form more complicated three-dimensional structures. For example, four triangular tiles and a square tile can be used to form a hollow pyramidal solid and many three-dimensional structures as shown in FIG. 33. Voids or perforations 18 may be formed in the core to reduce weight or for decorative purposes.

Figure 16:
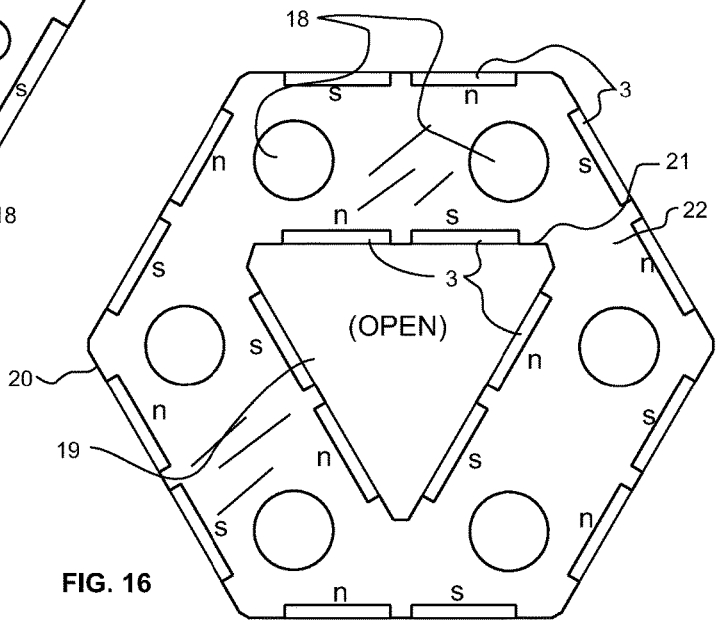
FIG. 16 is a schematic illustration of a hexagonal tile with insert edge magnetic elements.

Facings may be transparent or translucent colored films to create interesting visual effects or to trap movable objects in a void of the core. As shown in FIG. 16, interior openings designed to accept additional tile 19 can also be employed to provide a way to make magnetic connections within or out of the plane from interior magnetic edges. The hexagonal tile 20 shown has a triangular void opening 21 with magnets 3 mounted in notches along the edges of the void, designed to accept other tile with matching edge length. Facings can be wrapped onto the hexagonal core 22 to trap the interior edge magnets in a similar manner to that described earlier for exterior edge magnets. The interior magnets provide a base for forming more complicated three-dimensional structures with additional tiles. For the triangular opening illustrated, one triangular tile may be placed and held magnetically in the plane of the hexagonal tile. Or three triangular tiles can be attached to form a three-sided pyramid extending out of the plane of the hexagonal tile. Alternatively, three square tiles can be used to form a hollow triangular column with sides perpendicular to the hexagonal tile.

Figure 17:
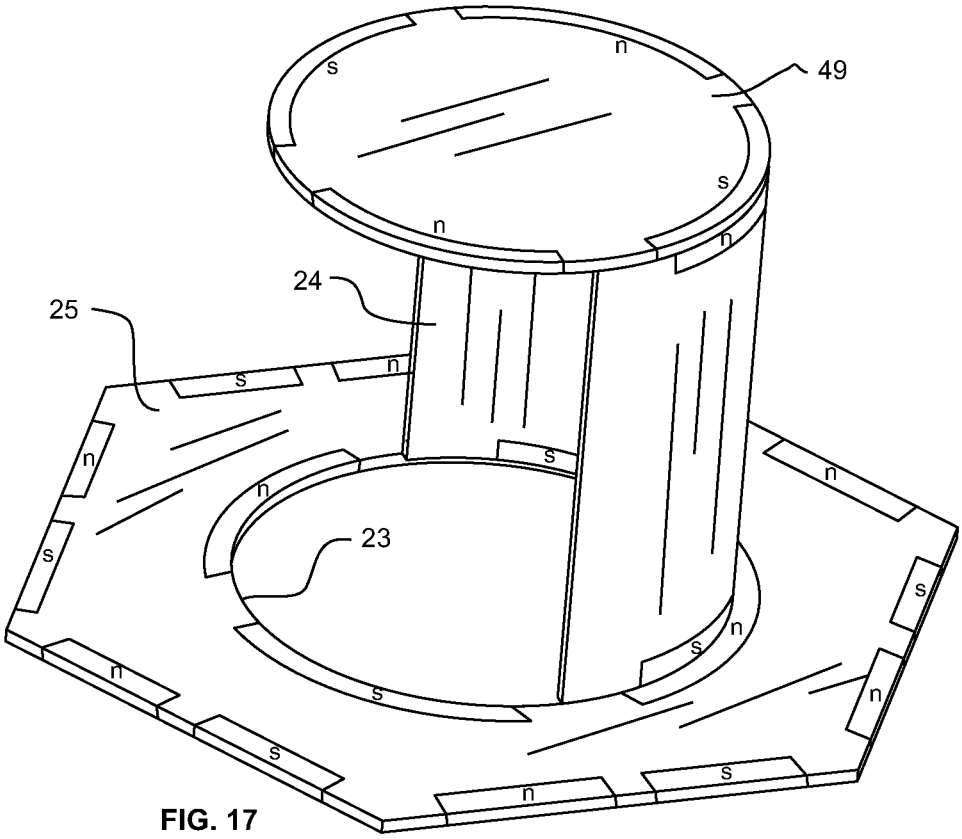
FIG. 17 is a schematic representation of magnetic building elements with curved interfaces.

Although the examples provided above discuss planar tiles, the ability to easily bend or form the plastic magnets provides a cost-effective method to form tiles with curved edges. These can be of the shape of simple hollow cylinders with a single curve, or they may be more complicated shapes containing compound curves such as saddles. Planar tiles may be shaped on one or more edges to match the curvature and magnet size of curved tiles to build more complicated three-dimensional structures. For example, a circular void 23 with magnets could be substituted for the triangular void shown in FIG. 16 to provide an attachment point for attaching semi-cylindrical tiles 24 and curved/circular flat tile 49 to the hexagon 25. This is illustrated in FIG. 17 where a curved partial cylinder is affixed at the lower end with curved magnets to a circular void having interior curved magnets set into notches. Curved magnets on a circular disk are magnetically attached to curved magnets built into the top edge of the partial cylinder. In addition to toy construction elements with curves formed and fixed during manufacturing of the tiles, curves may be formed temporarily by the user during play depending upon the stiffness and other mechanical properties of the core and magnets.

Figure 18:
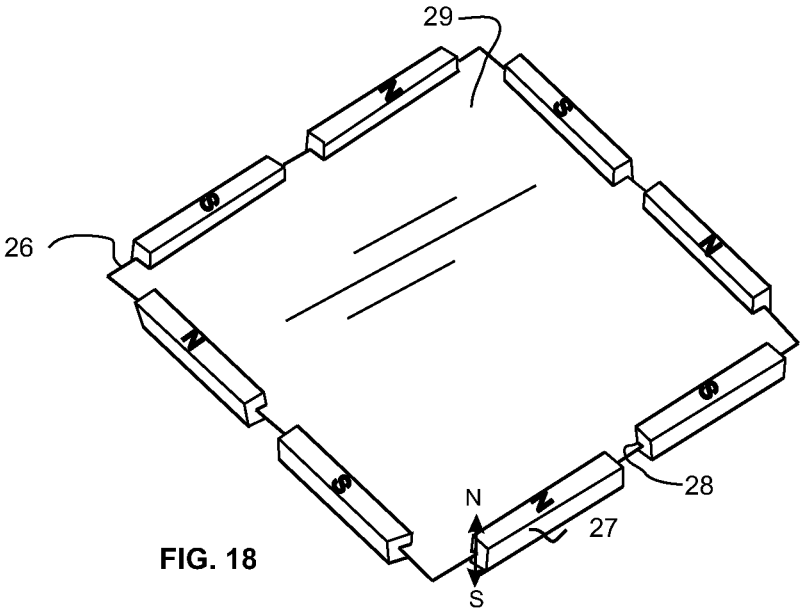
FIG. 18 is a schematic illustration of a kit comprising slit magnets mounted to the periphery of a square core.

The plastic magnets may also be used to create planar tiles without facings that are used to capture the magnets. Depending upon size and magnetic strength, loose plastic magnets may be safe for younger children to use. FIG. 18 shows a planar magnetic construction tile 26 that has slotted magnets 27 arranged with alternating poles as in previous embodiments. The plastic magnets have slots 28 on one edge sized to accommodate the thickness of the slotted magnet core 29 (See FIG. 20). These slots may be formed, for example, during an extrusion process or may be machined after the plastic magnets are produced. If the core is sufficiently thin, such as a card stock or photographic paper, the slot may simply be a slit cut into the edge of a magnet with a blade. Since no magnetic material is removed, the slit may be considered to be a groove that has no appreciable width until a substrate is inserted. The magnets may be attached to the core through friction or with adhesives or other bonding approaches. FIG. 18 shows rectangular cross-section plastic magnets like the first embodiment, but the cross-sectional shape can be rectangular, hexagonical, or other symmetric or asymmetric shapes. If magnets made of the same magnet material and size are used as described in force measurements above, the magnetic attractive forces between tiles in this embodiment will be higher because the facing thickness between pairs of magnets is eliminated.

Figure 19:
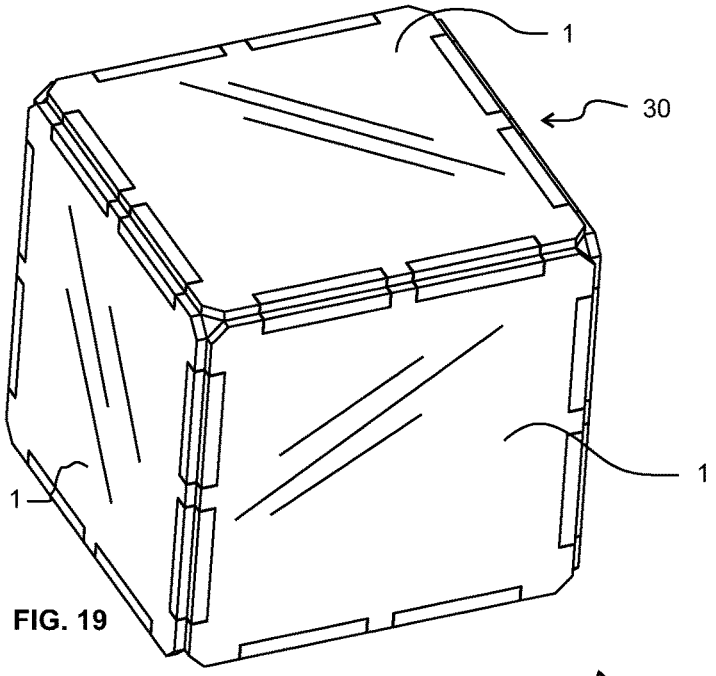
FIG. 19 is a schematic illustration of an assembly of planar magnetic tiles.

Magnets in this form can be supplied as part of a kit for consumers to build tiles that can be assembled into three-dimensional structures using sports trading cards, for example, as the core material. If cores are provided in a kit, they may be supplied in final size, or may be cut or separated from a sheet after printing on a desk-top printer. The cores may be folded in a manner similar to the previous embodiment and curved magnets and/or curved cores may be used in this kit. Although plastic magnets have been previously used to connect photographs into planar arrays, this embodiment allows a consumer to convert photographs into magnetic building tiles that may be assembled into complex three-dimensional structures with photos visible on one or more faces. This is illustrated schematically in FIG. 19 where a cube assembly 30 is formed from square tiles 1 similar to those described in FIGS. 1-5. Note that a user of these kit elements can choose how many magnets to insert on the edge of each core element; it is not necessary to have two magnets per edge in the configuration shown if lower functionality is acceptable.

Figure 20:
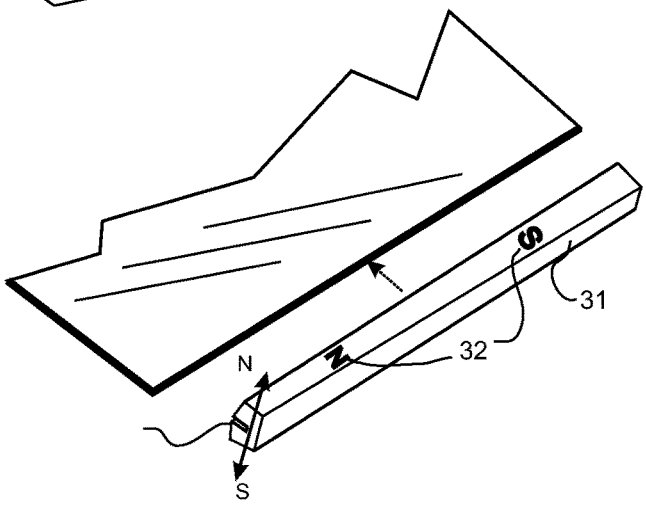
FIG. 20 is an alternate version of a kit element showing multiple poles in a single magnet.
Figure 21:
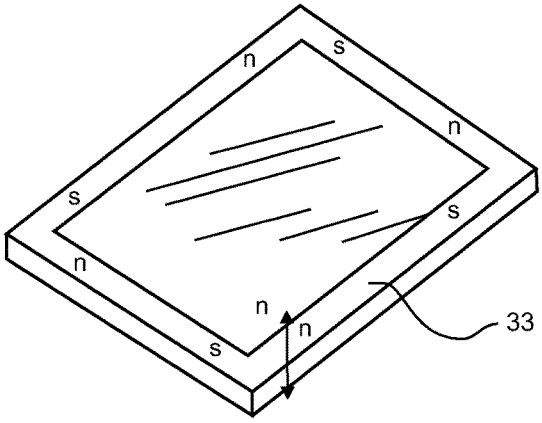
FIG. 21 is a schematic representation of a continuous plastic magnet that completely surrounds the edge of a planar tile core.
Figure 22:
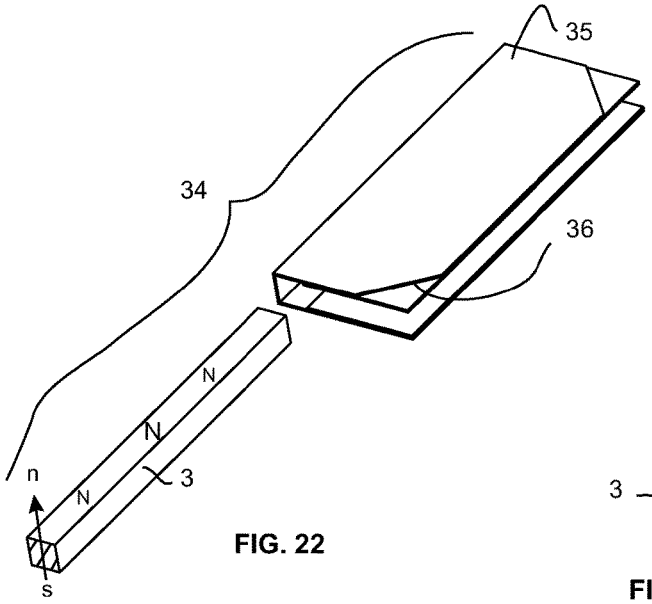
FIG. 22 is a representation of an alternate embodiment of magnetic tile kit elements.
Figure 23:
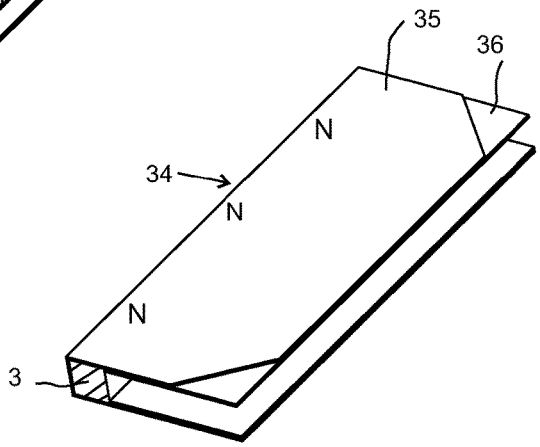
FIG. 23 is a top view of a representation of a magnetic tile kit element.
Figure 24A:
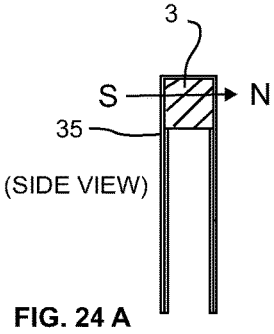
FIG. 24A is a cross-sectional view of a magnetic tile kit element.
Figure 24B:
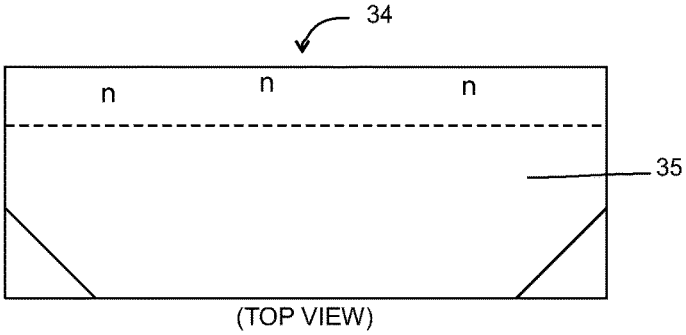
FIG. 24B is a top view of a magnetic tile kit element.

The form of the magnets in the embodiments described above is not limiting. Plastic magnets in particular are routinely magnetized to create adjacent areas of opposite magnetic polarity. As illustrated in FIG. 20, opposite poles 32 may be formed on a single piece of plastic magnet 31. Further, since there is no need to keep the magnets in this disclosure away from other magnets in a tile as is suggested in the prior art with magnetic tiles incorporating strong rotating magnets, the plastic magnet material 33 can extend completely around the periphery of a tile as a single piece as shown in FIG. 21. In order to maintain the fringing magnetic attractive forces in three dimensions, the magnet cross section of this extended magnet should approximate the equivalent individual magnet case. Since plastic magnets can be extruded, magnetic tubes can be extruded, cut, and attached to cores, and magnetized to make construction tiles through any methods analogous to those described above with discrete magnets.

Figure 25:
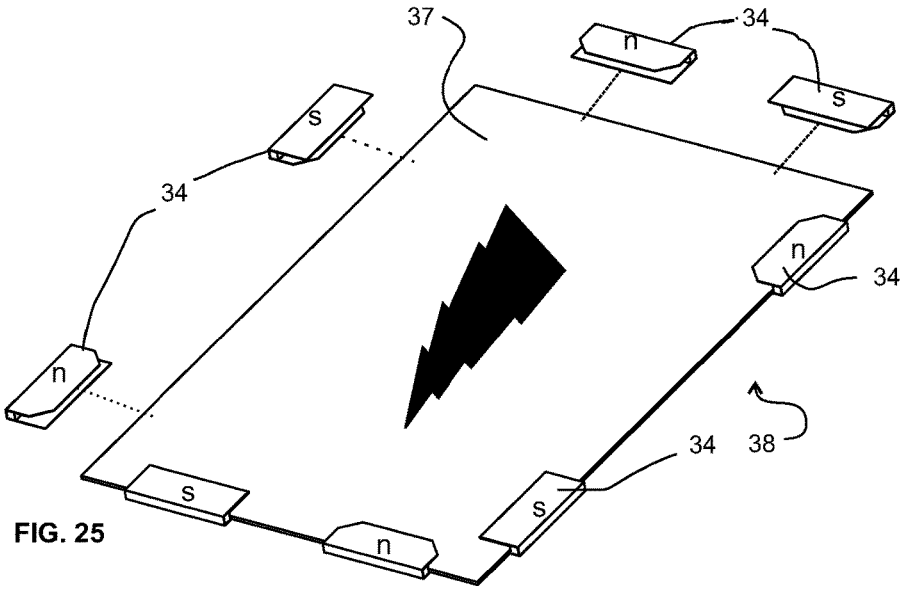
FIG. 25 is a schematic representation of a partially assembled magnetic tile kit and substrate.

FIGS. 22-25 illustrate another embodiment of a magnetic tile kit element 34 that can be combined with a core 37 to form a magnetic tile 38. In this case, a magnet 3 is inserted into and attached to a formed tab structure 35. For example, the tab structure can be fabricated from a sheet of flexible or rigid polymeric film sized to fit the magnet. The magnet shown is a plastic bar magnet with the magnetization poles oriented perpendicular to the long axis of the bar as in previous embodiments. A rectangular bar magnet is shown in the figure with magnetic poles oriented out of the plane of the tile as in previous embodiments, but poles may be oriented in the plane. The tab structure may include notches 36 or other indicia to indicate magnetic polarity or to provide access to a release liner for an adhesive on the inner portion of the tab. The tab may be designed to accommodate a particular range of thickness of core material. Adhesive may be used to attach the magnet to the tab and/or to attach the magnetic tab system to a core material. Other mechanical means of entrapment or attachment are possible, so adhesive is only provided as a non-limiting option. After attaching magnetic tab systems to a core to produce a magnetic tile as shown in FIG. 25, a plurality of tiles made in this manner may be assembled into three-dimensional structures. It may be convenient to provide the magnetic tab elements as an extended strip that may be cut or snapped to length as part of a kit.

Figure 26:
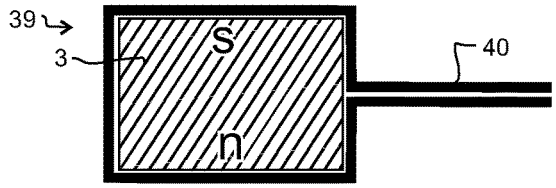
FIG. 26 is a side-view representation of a magnetic tile kit element in an alternate embodiment.
Figure 27:
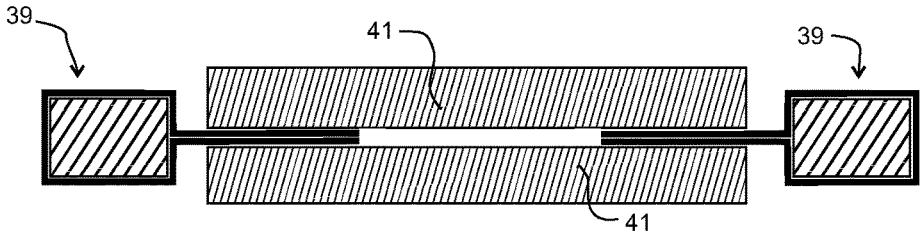
FIG. 27 is a cross-sectional view of the magnetic tile kit element assembled to two cores.

The embodiment above has the magnetic tab structure positioned on a portion of the top and bottom faces of a piece of core material. The spacing between ends of the tabs as shown has the same thickness as the magnet. Depending upon the flexibility of the tab, the range of core thicknesses may be limited to be approximately the same or smaller than the magnet thickness. As shown in FIG. 26, an alternate approach is to have the tab structure 39 designed to enclose the cross section of the magnet. The thin extension ear 40 of the magnetic tab may then be sandwiched between two pieces of core material 41 or mounted in a groove of a thicker core material, or attached to one or the other side of a single core layer. In this way, the thickness of the overall core becomes more independent of the magnet thickness. If the overall core thickness exceeds the magnet thickness, interference between core edges at different angles must be considered. The magnet may be positioned away from the edge of the core to allow the magnetic tab portions surrounding the magnets to touch at the minimum tile intersecting angle of interest.

Figure 28:
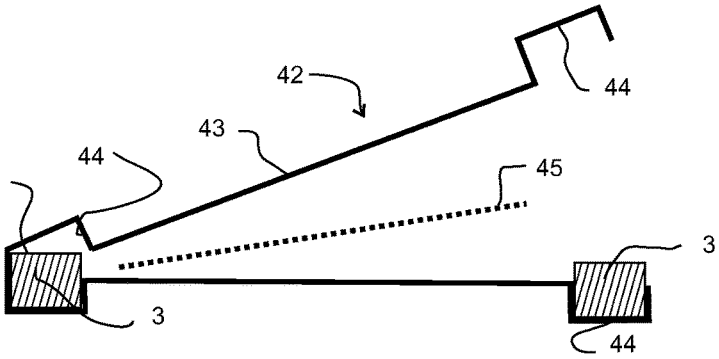
FIG. 28 is a cross-sectional representation of an alternate embodiment of a kit partially assembled.
Figure 29:
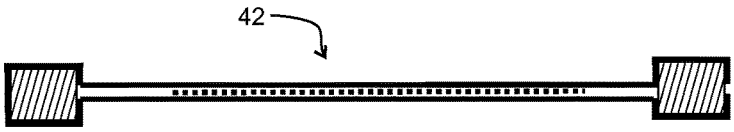
FIG. 29 is a cross sectional view of an assembled kit in an alternate embodiment.
Figure 30:
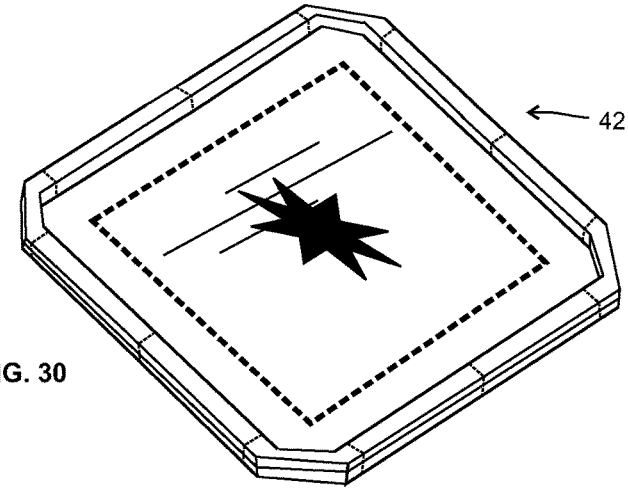
FIG. 30 is a schematic view of an assembled kit of an alternative embodiment.

FIGS. 28-30 show an alternative magnetic tile clamshell kit 42. In this embodiment, the ears of the individual magnetic tabs are extended to connect with one another to form a plate magnets 3 are retained in an integral clamshell core 43 with cavities 44 integrally formed to retain and locate the magnets 3 across the central area of the tile. Magnets are retained in cavities around the periphery of the top and bottom surfaces of the tile. This clam shell arrangement can have discrete top and bottom pieces (not illustrated) or may be formed in a single piece with a hinge on one side. If the clam shell member is transparent, an image on a thin insert 45 can be sandwiched between clam shell sides to be visible and protected from damage. This arrangement may be used with different magnet materials and cross-sections. If weak plastic magnet materials are used, magnetic strength limitations favor avoiding overlaps of the top and bottom plates at the outer edges of the magnets during assembly. Any of the bonding and attachment methods described elsewhere in this disclosure can be employed here.

Figure 31:
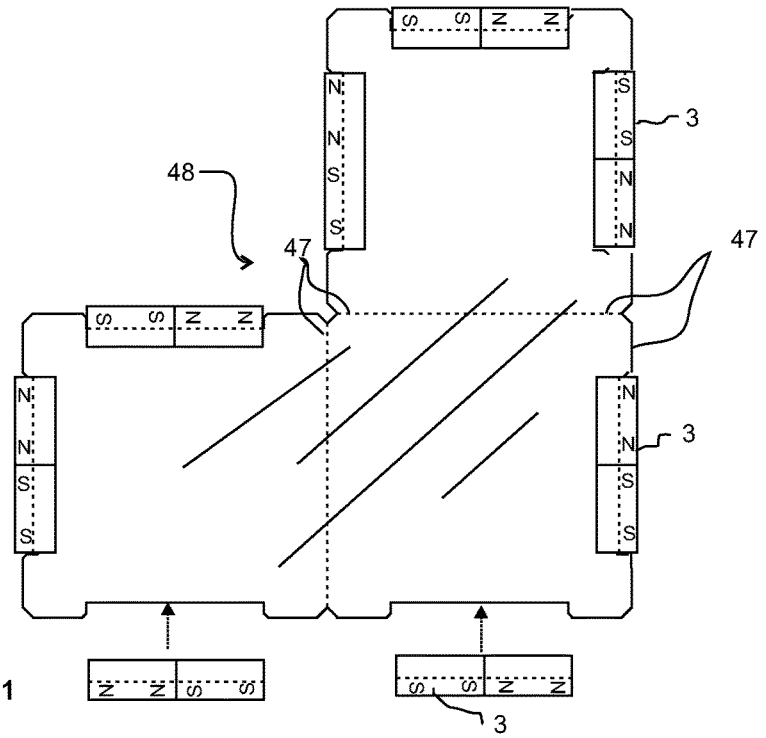
FIG. 31 is a top view of an embodiment of a folding planar tile.
Figure 32:
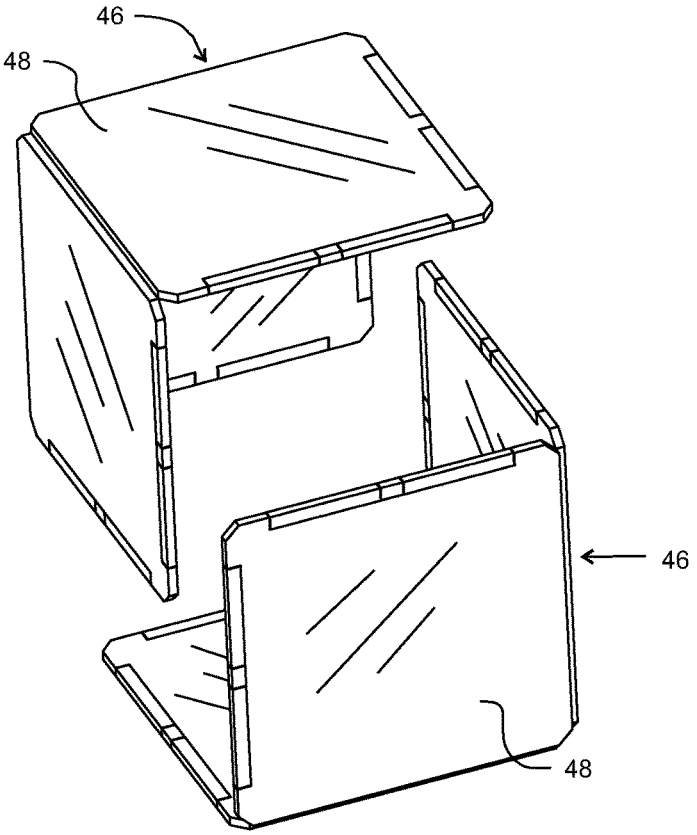
FIG. 32 is a schematic view of two folding tiles of FIG. 31 after folding positioned to be joined to make a cube.

In addition to bending into curves, tiles of more complex shape may be scored or compressed along fold lines to create folded three-dimensional hollow structures 46 with fewer discrete tiles. FIG. 31 illustrates an extended L-shaped tile 49 made up of 3 square sections. Magnets are located around the periphery of the L-shaped tile and facings are used to fix the magnets to the core as in the first embodiment. The core may be compressed to create preferred bending zones 47 along the lines that separate the tile into 3 equal square areas. By folding along these lines, magnets along two edges of square section can be brought into proximity to form an open half-cube structure as shown in FIG. 32. If two of these structures are brought together, a hollow cube may be formed. As shown, magnets are not placed along the fold lines, which means a cube can be constructed from fewer pieces having fewer magnets than if the cube were made from six loose squares of the first embodiment, although the fold edges would not provide any magnet attachment point to other cubes or tiles. If desired, notches and one or two magnets or a ferromagnetic element could be inserted at each of the fold lines. In this case, cuts in the outside fold edge facing or the core may improve folding. Folding of tiles is not restricted to three sides of a cube, but can be extended to all six sides of a cube or to other portions of three-dimensional shapes.

Several embodiments of the invention have been described with a focus on using weak plastic magnets in lightweight structures for toy construction applications. If the kit is not a toy or is designed for older children or adults, toy safety concerns may be reduced and any type of magnet may be used in the embodiments that do not require magnet bending. Stronger magnets than the plastic magnets discussed earlier may be significantly shorter or different cross-sectional shapes while providing adequate attractive forces for non-toy use of some of the inventive concepts contained in this disclosure.

It should be understood that the concepts described in connection with one embodiment of the invention may be combined with the concepts described in connection with another embodiment (or other embodiments) of the invention.

While an effort has been made to describe some other alternatives to the preferred embodiment, other alternatives will readily come to mind to those skilled in the art. It will be readily understood to those skilled in the art that various other changes in the details, material and arrangement of the parts and method stages which have been described and illustrated in order to explain the nature of this subject matter may be made without departing from the principles and scope of the subject matter as expressed in the subjoined claims.

What is claimed is:

1. A toy construction set of substantially planar tiles having three or more edges forming a tile perimeter, the set comprising:

a first tile and one or more second tiles wherein the first tile and each second tile comprise one or more plastic magnets having a length, width and thickness wherein the magnet length is significantly larger than the magnet width and magnet thickness and wherein the magnetic polarization extends through the one or more magnets in directions perpendicular to the plane of the tiles; and a core; and attachment means for affixing the magnet to the core along one or more edges of the tile with the magnet length locally parallel to the one or more edges of the tile; and wherein the first and second tile have an areal density less than about 0.2 g/cm$^2$, and wherein the magnets are capable of attracting an edge of the first tile to an edge of a second tile with a force greater than the weight of the second tile at a relative angle between the first and second tiles over the range of 45 degrees to 180 degrees.

2. The toy construction set of claim 1, wherein the plastic magnets have a cross section ratio perpendicular to their length in which the larger dimension of the cross-section is not more than 3 times the smaller dimension.

3. The toy construction set of claim 1, wherein the plastic magnets have an energy product of less than 1.5 MGOe.

4. The toy construction set of claim 1, wherein the pull force in the direction of 90 degrees between the first and a second tile is greater than the weight of five first tiles.

5. The toy construction set of claim 1, wherein the first tile and a second tile have thicknesses less than 5 mm.

6. The toy construction set of claim 1, wherein the thickness of the first tile is no more than 2% of the perimeter of the first tile.

7. The toy construction set of claim 1 wherein the core and at least one of the plastic magnets of the first tile are flexible.

8. The toy construction set of claim 1 wherein the first tile has at least one plastic magnet shaped to have a curvature along the length of the magnet with a radius less than 30 times the core thickness.

9. The toy construction set of claim 1 wherein the core of the first tile may be folded from its planar form to create multiple sides of a three-dimensional structure.

10. The toy construction set of claim 1 wherein the attachment means for affixing comprises a film, and wherein the film has a thickness of less than 0.2 mm.

11. The toy construction set of claim 1 wherein the attachment means comprises a groove in the magnet that is sized to fit a portion of the core within the groove.

12. The toy construction set of claim 1 wherein an edge of the first tile includes adjacent areas of opposite magnetic polarity.

13. The toy construction set of claim 1 wherein the attachment means for affixing comprises a cavity wherein the magnet is affixed within the cavity.

14. The toy construction set of claim 1 wherein the first tile is capable of being folded with a bend radius less than 8 times the tile thickness proximate the one or more magnets.

15. The toy construction set of claim 10 wherein a portion of the attachment film comprises a flexible film and wherein the attachment film wraps around portions of three sides of the one or more flexible magnets and is affixed to at least a portion of a front surface of the core.

16. The toy construction set of claim 15 further comprising a facing wherein the facing is affixed to at least a portion of the attachment film and a portion of the front surface of the core.

* * * * *